United States Patent [19]

Sofy

[11] Patent Number: 5,060,908

[45] Date of Patent: Oct. 29, 1991

[54] MAIL POST

[76] Inventor: Hugh M. Sofy, 201 Warrington, Bloomfield Hills, Mich. 48013

[21] Appl. No.: 127,531

[22] Filed: Dec. 3, 1987

Related U.S. Application Data

[63] Continuation of Ser. No. 7,407, Jan. 27, 1987, abandoned.

[51] Int. Cl.[5] ..... F16M 13/00

[52] U.S. Cl. ..... 248/545; 248/156; 248/146; 232/17; 232/39; 52/165; 52/731

[58] Field of Search ..... 248/545, 530, 522, 533, 248/76, 146, 159, 156, 170, 219.2; 256/DIG. 5; 52/165, 731, 728; 232/39, 17–19

[56] References Cited

U.S. PATENT DOCUMENTS

| | | | |
|---|---|---|---|
| 314,654 | 3/1885 | Cox | 52/165 |
| 1,020,740 | 3/1912 | Budd | 248/159 |
| 1,130,089 | 3/1915 | Krolikowski | 52/165 |
| 1,504,514 | 8/1924 | Ryther | 232/17 |
| 1,982,569 | 11/1934 | Byrd | 52/728 |
| 2,552,915 | 5/1951 | Zachrich | 232/39 |
| 3,066,769 | 12/1962 | Pasquale | 248/530 |
| 3,163,356 | 12/1964 | Joehnk | 232/17 |
| 3,243,104 | 3/1966 | Fillcon | 232/39 |
| 4,333,218 | 6/1982 | Wentworth | 52/728 |
| 4,620,815 | 11/1986 | Goetter | 403/405.1 |
| 4,646,505 | 4/1984 | Credle | 248/300 |
| 4,646,505 | 3/1987 | Paris | 52/731 |

*Primary Examiner*—Alvin C. Chin-Shue

*Attorney, Agent, or Firm*—Reising, Ethington, Barnard, Perry & Milton

[57] ABSTRACT

A mailbox support post assembly (13) comprising an elongated hollow member (15) consisting of two identical parts (20, 22), each part (20, 22) having a cross-section characterized by a bulged central portion (24, 26) and flanges (28, 30 and 32, 34) extending from each side of the bulged central portion (24, 26). A mailbox support portion (40, 42) extending outwardly and upwardly from the elongated hollow member (15) for receiving a mailbox. An anchor shaft (70) may be clamped between the bulged central portions (24, 26).

13 Claims, 3 Drawing Sheets

MAIL POST

This application is a continuation of application Ser. No. 007,407, filed Jan. 27, 1987 now abandoned.

TECHNICAL FIELD

The subject invention relates to a post assembly for supporting a mailbox.

BACKGROUND ART

Support posts typically comprise an elongated shaft with one end retained in a base support (i.e., the earth, concrete, etc.) and the other end supporting an object (i.e., mailbox, sign, etc.). Some post assemblies comprise two identical parts; for example, the U.S. Pat. Nos. 390,951 to Dow issued Oct. 9, 1888, and 4,386,762 to Collins issued June 7, 1983 disclose such elongated support shafts, however neither disclose the two parts as engaging along mating flanges.

Post assemblies including a ground inserted anchor shaft are also known, however, none disclose the elongated post clamped about the anchor shaft. For example, the U.S. Pat. No. 4,249,715 to Repp issued Feb. 10, 1981 discloses an elongated post and a ground inserted anchor shaft but the post does not clamp around the anchor shaft. Also the U.S. Pat. No. 4,395,012 to Ranco issued July 26, 1983 discloses an anchor shaft clamping to an elongated post. These prior art assemblies include numerous components requiring multiple manufacturing operations, resulting in an expensive finished product to the consumer.

SUMMARY OF THE INVENTION AND ADVANTAGES

According to the present invention, an assembly for supporting mailboxes includes an elongated hollow member comprising two identical parts which are symmetrical with one another along a plane longitudinal to the hollow member and contained within the hollow member's central axis. In other words, the two identical parts are symmetrical about a plane extending centrally along the length of the hollow member. The parts are characterized by each cross-section including a central bulged portion and flanges extending laterally from either side of the bulged portion. The flanges of one part correspond to and engage the flanges of the other part to define the mailbox support assembly.

The manufacture of the mailbox support assembly is economically efficient since only one part is manufactured. The single part is easily and economically nested with like parts for shipment. Additionally, the assembly is easily placed into service by assembly together and about a support anchor.

FIGURES IN THE DRAWINGS

Other advantages of the present invention will be readily appreciated as the same becomes better understood by reference to the following detailed description when considered in connection with the accompanying drawings wherein.

DETAILED DESCRIPTION OF THE DRAWINGS

Figure 1:
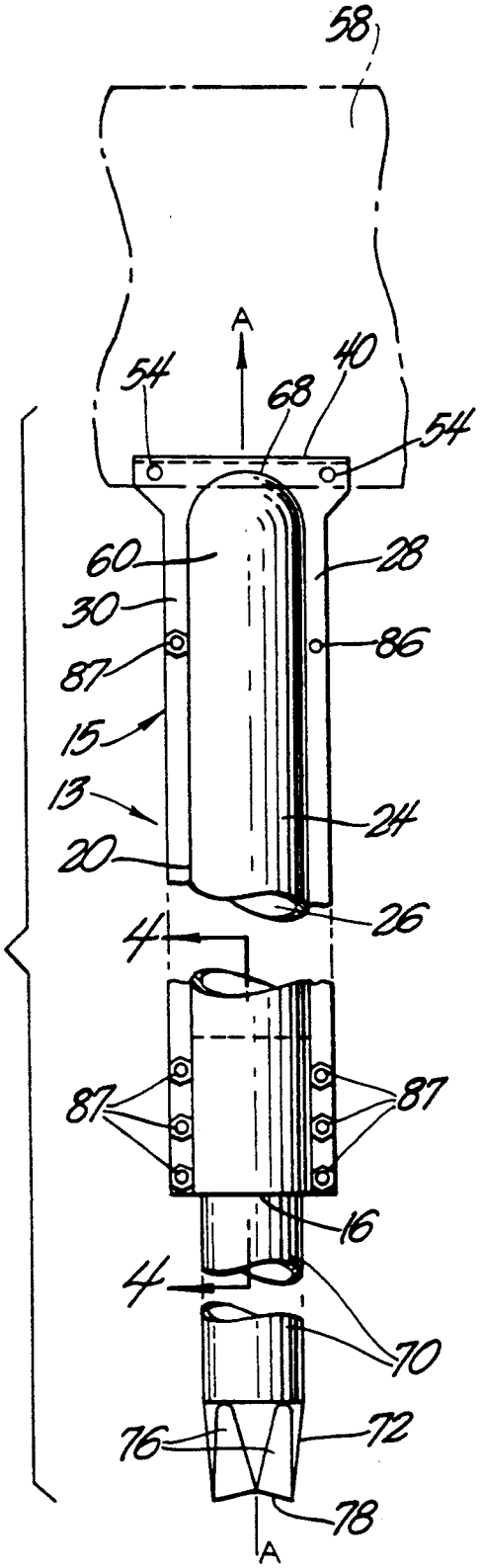
FIG. 1 is a side view of a preferred embodiment of the subject invention with a mailbox in phantom supported thereon.

A mailbox post assembly is generally shown at 13. The assembly 13 comprises an elongated hollow member, generally indicated at 15, including a top end 14 and a bottom end 16. The hollow member 15 consists of two identical parts 20 and 22 which are symmetrical about both sides of a plane extending longitudinally through a central axis A of the hollow member 15.

Figure 11:
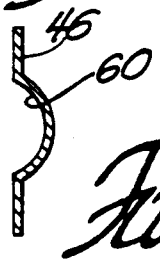
FIG. 11 is a cross-sectional view of the gusseted arm taken substantially along lines 11—11 of FIG. 9.

The mailbox post assembly 13 is characterized by each of the parts 20, 22 having a transverse cross-section including bulged central portions 24, 26, respectively. The part 20 includes flanges 28, 30 extending laterally from the bulged central portion 24, as shown in FIG. 11. The part 22 includes flanges 32, 34 extending laterally from the bulged central portion 26. The flanges 28, 30 of the part 20 engage and mate to the flanges 32, 34 of the part 22 to define the mailbox post assembly 13. In other words, the flanges 28, 30, which extend from either side of the bulged portion 24 of one part 20, engage the flanges 32, 34 of the other identical part 22, and when mated define an elongated hollow member 15 comprising the subject assembly 13. Said another way, the parts 20 and 22 are identical and different reference numerals are used only to facilitate description.

The post assembly 13 is further characterized by each of the parts 20, 22 providing mailbox support portions 40, 42 extending radially outwardly from the central axis A. The mailbox support portions 40, 42 are displaced from the central axis A by arms 46, 48, respectively, which extend upwardly and outwardly from each of the central bulged portions 24, 26.

The arms 46, 48 provide, respectively, generally L-shaped lips 50, 52 at each of the mailbox support portions 40, 42. The L-shaped lips 50, 52 are characterized by a first flange extending vertically upward from the arms 46, 48, and a second flange, perpendicular to the first flange, extending horizontally toward the central axis A. The lips 50, 52 each contain a plurality of apertures 54 through which fasteners are disposed for securing to a mailbox 58 (shown in phantom). Said another way, a mailbox 58 is positioned on the mailbox support portions 40, 42, and lips 50, 52 are provided with apertures 54 so that fasteners disposed therethrough engage with corresponding apertures in the mailbox 58 thus securing the mailbox 58 to the support post assembly 13.

In the preferred embodiment, the arms 46, 48 increase in width thereacross, i.e., fan out, from a minimum width at the flanges 28, 30 and 32, 34, to a maximum width at the lips 50, 52, respectively. For structural rigidity, each of the arms 46, 48 contain, respectively, a gusset 60, 62. The gussets 60, 62 extend from their respective bulged central portions 24, 26 and, as shown in transverse cross-section in FIG. 11, are characterized by an indentation or bulge similar to the bulge in bulged central portions 24, 26. The gusset indentations decrease from a maximum at the bulged central portion 24, 26 to a minimum or termination point 68 adjacent their respective lips 50, 52. In other words, the gussets 60, 62 decease in width from a width equal to the bulged portions 24, 26 to a rounded point 68.

Figure 2:
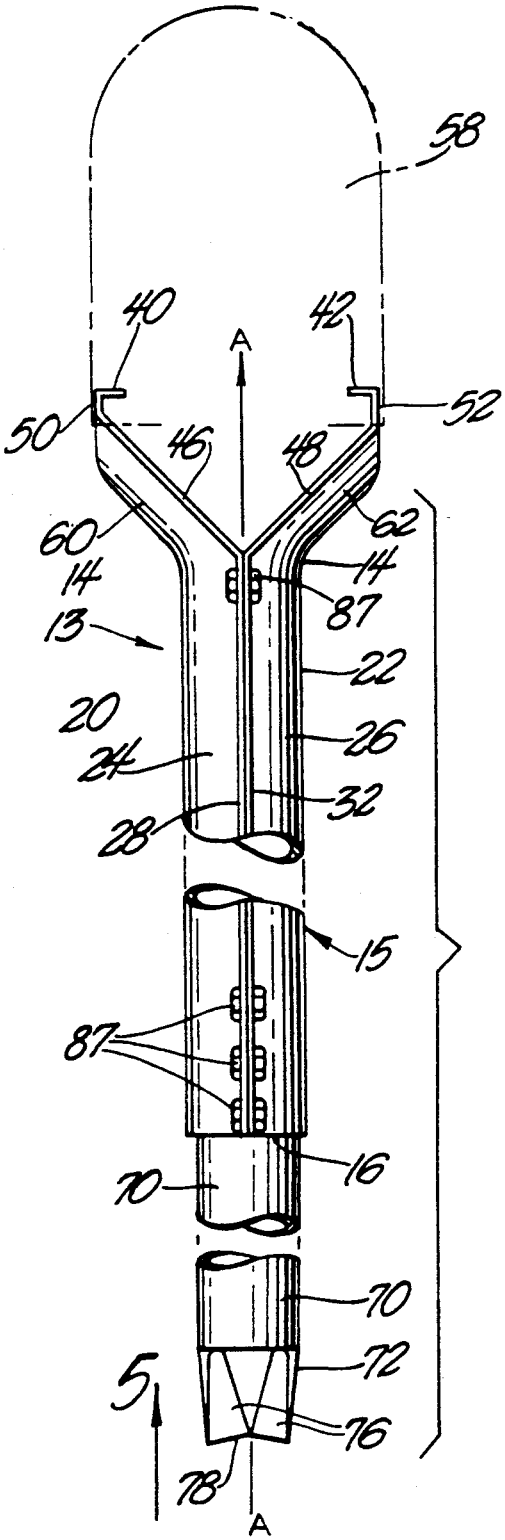
FIG. 2 is a front view of the preferred embodiment of the subject invention with a mailbox in phantom supported thereon.
Figure 4:
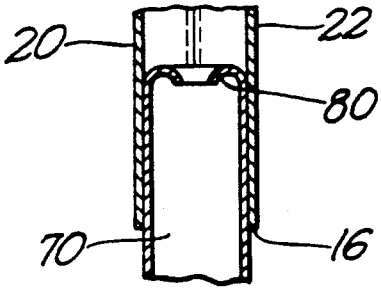
FIG. 4 is a fragmentary cross-sectional view taken substantially along line 4—4 of FIG. 1.
Figure 7:
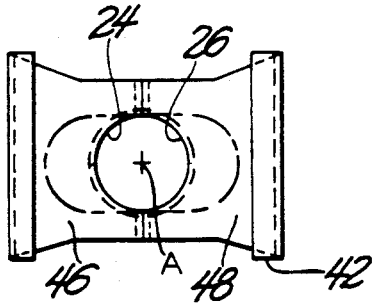
FIG. 7 is a top view taken on FIG. 2.

The support post assembly 13 may include an anchor shaft 70 which is inserted into a ground support, i.e., the earth, concrete, etc. The anchor shaft 70 is inserted only partway into the ground support so that the portion of the anchor shaft 70 extending above the ground support is clamped into the hollow member 15 at the bottom end 16 between the two identical parts 20, 22 and contained within the bulged central portions 24, 26, as shown in FIGS. 1, 2 and 4.

The outer dimension of the anchor shaft 70 is greater than the internal dimension of the elongated hollow member 15. This arrangement allows the anchor shaft 70 to be held in clamped engagement between the parts 20, 22. Said another way, the internal diameter created between the bulged central portions 24, 26 is less than the outer diameter of the anchor shaft 70 so that as the parts 20, 22 are fastened together the anchor shaft 70 becomes clamped therebetween.

Figure 5:
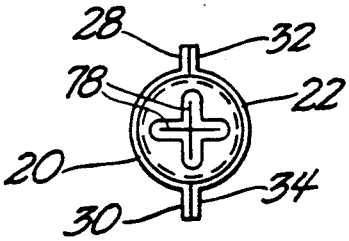
FIG. 5 is a bottom view taken from Arrow 5 of FIG. 2.

The anchor shaft 70 includes a pointed end portion 72 for efficient insertion into the earth. The pointed end portion 72 is shown in FIGS. 1, 2 and 5 as an integral continuation of the anchor shaft 70 consisting of four crimped indentations 76 coverging from the anchor shaft 70 outer diameter to define four narrow blades 78. Also, the narrow blades 78 are beneficial in preventing rotation of the anchor shaft 70 while inserted in the ground support. The anchor shaft 70 is further characterized as being hollow and having an inward curled upper portion 80, as shown in FIG. 4. During insertion into the earth, the upper portion 80 is repetitiously pounded upon with a mallet or other driving utensil to effect penetration therein. The upper portion 80 is curled inward for structural rigidity so that the pounding thereon will not deform the anchor shaft 70. Also, during removal of the anchor shaft 70 from the earth the inward curled upper portion 80 is advantageous for providing a means by which to hook a tool for pulling upward on the anchor shaft 70.

The flanges 28, 30 and 32, 34 of the identical parts 20, 22 extend the length of the parts 20, 22, i.e., from the bottom end 16 to the arms 46, 48. The flanges 28, 30 and 32, 34 are further characterized by providing a plurality of apertures 86 therethrough. The apertures 86 are spaced along the length of parts 20, 22 for receiving fasteners 87 to secure the parts 20, 22 together. In this manner, the parts 20, 22 are mated together along flanges 28, 30, 32 and 34, and retained in clamping engagement by fasteners 87 disposed through apertures 86.

As illustrated in the figures, the preferred embodiment of the subject invention characterizes the bulged central portions 20, 22 and the anchor shaft 70 as substantially cylindrical. However, it is to be understood that the invention is not to be limited to circular cross-sections. Other geometric cross-sectional configurations are possible and may be practiced without deviating from the scope of this invention.

Figure 3:
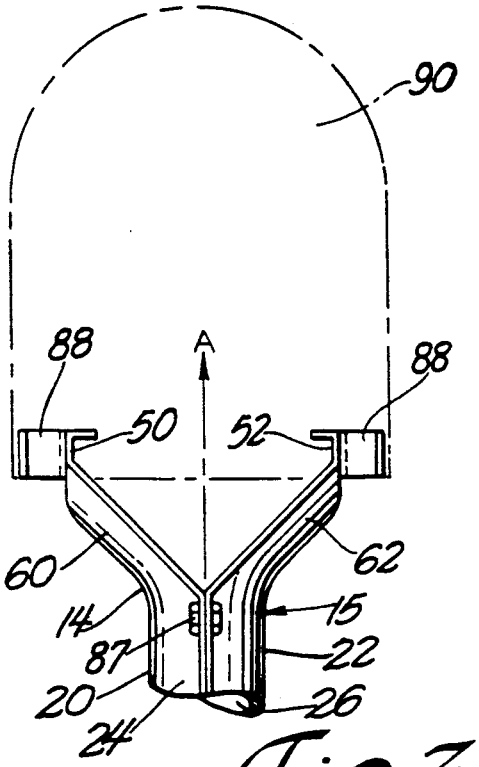
FIG. 3 is a fragmentary front view of the mailbox support portion including brackets for receiving an oversize mailbox which is shown in phantom.
Figure 6:
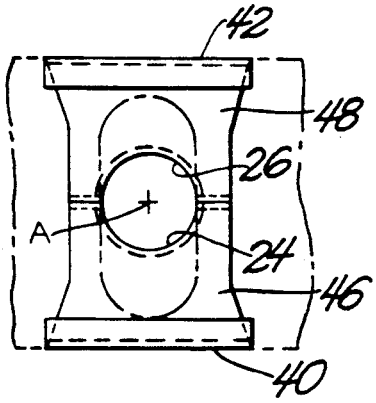
FIG. 6 is a top view taken on FIG. 1.
Figure 8:
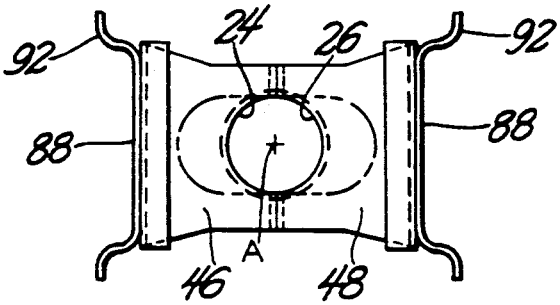
FIG. 8 is a top view taken on FIG. 3.
Figure 12:
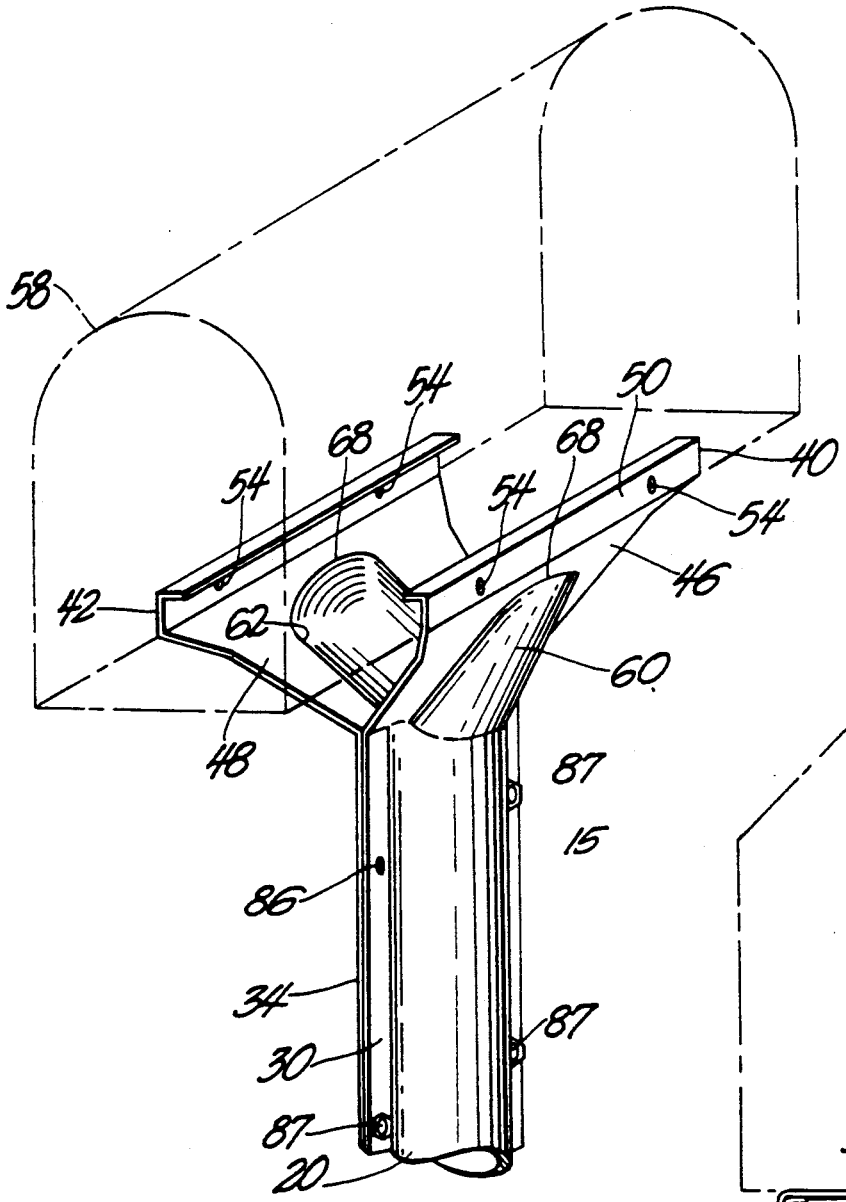
FIG. 12 is a fragmentary isometric view of the mailbox support portion of the subject invention.
Figure 9:
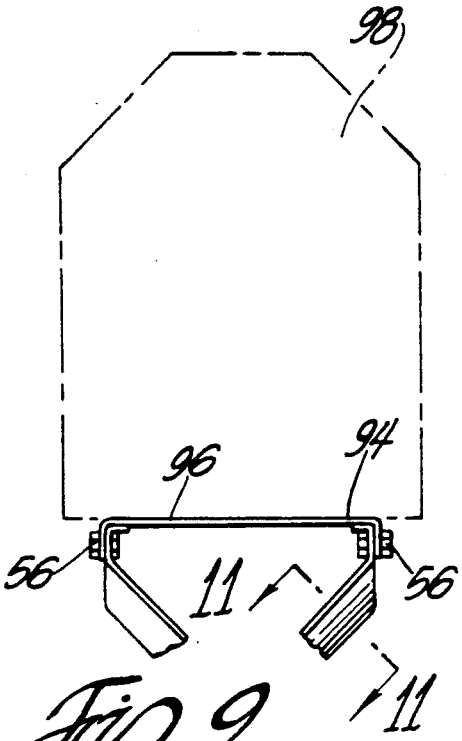
FIG. 9 is a fragmentary front view of the mailbox support portion including a bracket for receiving unique mailboxes.
Figure 10:
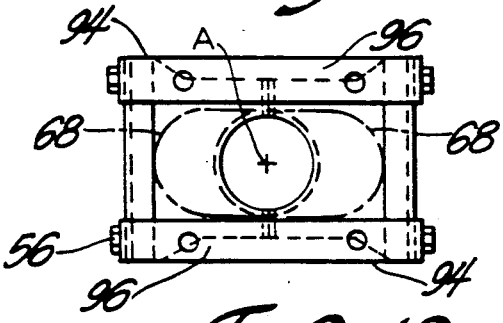
FIG. 10 is a top view taken on FIG. 9.

Due to the variability of mailbox sizes available to the consumer, it may become necessary to attach a bracket 88 on each of the lips 50, 52, as shown in FIGS. 3 and 8, to increase the width of the mailbox support portions 40, 42 for receiving an oversize mailbox 90 (shown in phantom in FIG. 3). The bracket 88 is attached to each of the lips 50, 52 by suitable fasteners presented through the apertures 54 and through corresponding apertures disposed through the portion of the bracket 88 adjacent the lips 50 and 52. Extending from each end of the bracket 88 is an L-shaped flange 92. A first leg of the L-shaped flange 92 projects perpendicularly outward from the bracket 88 in a direction away from the lips 50, 52. A second leg of the L-shaped flange 92 extends perpendicularly from the first leg in a direction away from the lips 50, 52. The second leg of each of the L-shaped flanges 92, parallel to the lips 50 and 52, are provided with apertures therethrough for retaining fasteners to engage the oversize mailbox 90. Alternatively, two U-shaped brackets 94 may span across the mailbox mounting portion 40, 42, from lip 50 to lip 52, for providing two co-planer mailbox mounting surfaces 96 to support an irregular sized mailbox 98, as shown in FIGS. 9 and 10. In this arrangement, the ends of each U-shaped bracket 94 extend perpendicularly downward from the mounting surface 96 for disposition over the exterior of the lips 50, 52. Of course, other bracket configurations which perform the same function as those described above and shown in FIGS. 3, 8, 9 and 10 are possible for receiving nonstandard size mailboxes.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A mailbox post assembly (13) comprising; an elongated hollow member (15) extending between top (14) and bottom (16) ends, said hollow member (15) consisting of two identical parts (20, 22) symmetrical with one another on either side of a plane extending longitudinally of said hollow member (15) and containing a central axis (A) thereof, said assembly (13) characterized by each of said parts (20, 22) having a constant cross-section extending from said top end (14) to said bottom end (16) of said hollow member (15) including a bulged central portion (24, 26) and flanges (28, 30, 32, 34) extending laterally outwardly from either side of said bulged portion (24, 26) for mating engagement of the flanges (28, 30) of one part (20) with the flanges (32, 34) of the other part (22) to define said assembly (13), each of said parts (20, 22) including a mailbox support portion (40, 42) disposed radially outwardly from said top end (14) of said bulged portions (24, 26) from said central axis (A), said flanges (28, 30, 32, 34) and said bulged central portions (24, 26) extending straight and parallel from said end (16) for mating said parts (20, 22) together with the lower ends of said bulged portions (24, 26) clamped about an anchor shaft (70), and including an anchor shaft (70) for insertion into ground support and to be clamped between said parts (20, 22) in said bulged central portions (24, 26) thereof at the bottom ends (16) thereof, with the outer dimensions of said anchor shaft (70) being slightly greater than the internal dimensions of said hollow member (15).

2. An assembly as set forth in claim 1 further characterized by said anchor shaft (70) having a pointed end portion (72) for insertion into the ground.

3. An assembly as set forth in claim 2 further characterized by said anchor shaft (70) being hollow and having an inward curled upper end portion (80) for structural rigidity during pounding thereon during insertion into the ground.

4. An assembly as set forth in claim 3 further characterized by said anchor shaft (70) having a pointed lower end portion (72) comprising crimped indentations (76) to define narrow blades.

5. An assembly as set forth in claim 1 further characterized by said flanges (28, 30, 32, 34) containing a plurality of apertures (86) therethrough for receiving fasteners (87) to secure said parts (20, 22) together.

6. An assembly as set forth in claim 1 further characterized by each of said parts (20, 22) having an upwardly and outwardly extending arm (46, 48) terminating in a mailbox support portion (40, 42) disposed radially outwardly of said bulged central portion (24, 26) from said central axis (A) for receiving a mailbox.

7. An assembly as set forth in claim 6 further characterized by each of said arms (46, 48) having a lip (50, 52) containing a plurality of apertures (54) disposed therethrough for retaining fasteners (56) to secure a mailbox thereon.

8. An assembly as set forth in claim 7 further characterized by a bracket (88) secured to said lips (50, 52) including L-shaped flanges (92) extending from each end of said bracket (88) in an outward direction from said lips (50, 52) for adapting said mailbox support portions (40, 42) to receive an oversize mailbox.

9. An assembly as set forth in claim 7 further characterized by two generally U-shaped brackets (94) spanning across said mailbox mounting portion (40, 42), said U-shaped brackets (94) providing co-planar mounting surfaces (96) for supporting an irregular size mailbox, said U-shaped bracket (94) characterized by each end of said U-shaped bracket (94) extending downwardly, perpendicular to said mounting surface (96), for disposition about the exterior of each of said lips (50, 52).

10. An assembly as set forth in claim 7 further characterized by the distance across each of said arms (46, 48) increasing from a minimum at said flanges (28, 30, 32, 34) to a maximum at said lip (50, 52).

11. An assembly as set forth in claim 10 further characterized by each of said arms (46, 48) containing a gusset (60, 62) extending from said bulged central portion (24, 26) for increasing the structural rigidity of said arm (46, 48).

12. An assembly as set forth in claim 11 further characterized by said bulged central portions (24, 26) being substantially cylindrical.

13. An assembly as set forth in claim 12 further characterized by said flanges (28, 30, 32, 34) containing a plurality of apertures (86) therethrough for receiving fasteners (87) to clamp said parts (20, 22) together.

* * * * *